US005758382A

United States Patent [19]

Maekawa et al.

[11] Patent Number: 5,758,382

[45] Date of Patent: Jun. 2, 1998

[54] INTERDENTAL BRUSH HANDLE

[75] Inventors: Kiyoshi Maekawa, Mount Prospect; Scott Koepsel, Waukegan, both of Ill.

[73] Assignee: John O. Butler Company, Inc., Chicago, Ill.

[21] Appl. No.: 528,472

[22] Filed: Sep. 12, 1995

[51] Int. Cl.[6] ..... A46B 9/01

[52] U.S. Cl. ..... 15/167.1; 15/145; 15/176.5; 15/176.6; 132/321; 433/147; 403/397

[58] Field of Search ..... 15/167.1, 145, 15/176.5, 176.6, 176.4, 206, 185, 176.1, 194; 132/308, 311, 321, 329, 309; 433/147; 403/373, 397, 405.1; 292/80, 87, 88

[56] References Cited

U.S. PATENT DOCUMENTS

| | | | |
|---|---|---|---|
| 1,472,853 | 11/1923 | Neff | 15/177 |
| 1,684,855 | 9/1928 | Acheson | 15/167.1 |
| 2,287,327 | 6/1942 | Rickenbacher | 15/176.4 |
| 2,290,894 | 7/1942 | Rivanov | 15/167.1 |
| 3,559,226 | 2/1971 | Burns | 15/167.1 |
| 4,030,199 | 6/1977 | Russell | 15/206 |
| 4,222,143 | 9/1980 | Tarrson et al. | 15/167.1 |
| 4,319,377 | 3/1982 | Tarrson et al. | 15/167.1 |
| 4,751,761 | 6/1988 | Breitschmid | 15/176.5 |
| 4,805,252 | 2/1989 | Tarrson et al. | 15/176.1 |
| 5,027,467 | 7/1991 | Tarrson et al. | 15/176.5 |
| 5,029,358 | 7/1991 | Zimmerman | 15/206 |
| 5,090,080 | 2/1992 | Thuresson et al. | 15/167.1 |
| 5,293,661 | 3/1994 | Appleby | 15/167.1 |
| 5,435,033 | 7/1995 | Millner | 15/167.1 |

FOREIGN PATENT DOCUMENTS

| | | | |
|---|---|---|---|
| 509061 | 5/1957 | Italy | 15/176.4 |

*Primary Examiner*—Gary K. Graham

*Attorney, Agent, or Firm*—Laff, Whitesel, Conte & Saret, Ltd.

[57] ABSTRACT

An interdental toothbrush handle for holding a twisted wire brush includes a handle with a locking retainer connected thereto by a living hinge. The handle has two opposing side walls which extend perpendicularly from the handle and are adjacent to the living hinge. At least one of the walls includes a V-shaped gap for receiving the stem of a twisted wire brush. The handle also preferably has an indentation between the two opposing side walls and the locking retainer preferably includes a protrusion in communication with the indentation. A nub on the protrusion prevents the locking retainer from opening more than about 30° to 40°. The stem of a twisted wire brush is inserted into the V-shaped gap when the locking retainer is open. As the locking retainer is closed, the stem of the twisted wire brush is captured between the handle and locking retainer. A latch on the locking retainer passes through a hole in the handle to lock the retainer in place and hold the stem of the twisted wire brush firmly and securely.

10 Claims, 4 Drawing Sheets

INTERDENTAL BRUSH HANDLE

FIELD OF THE INVENTION

This invention relates generally to handles for interdental toothbrushes and, more particularly, to interdental brush handles which firmly and securely hold twisted wire brushes of varying diameters.

BACKGROUND OF THE INVENTION

The brushing of teeth serves two important purposes, specifically removing plaque and debris from the teeth and massaging the mouth tissue. This massaging allows the gum to develop a thicker and healthier surface layer for resisting attack from both disease and mechanical abrasion. Unfortunately, conventional toothbrushes are limited in their use to the tooth and gum surfaces that they can reach. For example, the interdental spaces located between and around the teeth, as well as the gum line are difficult to clean with conventional toothbrushes. Therefore, conventional toothbrushes may not effectively remove plaque, stimulate the gums and brush the gum line.

Interdental brush handles which hold twisted wire brushes are commonly used to achieve this brushing and massaging because the twisted wire brushes are able to fit within and through the interdental spaces. Twisted wire brushes, such as those disclosed in U.S. Pat. No. 4,395,943 (Brandli), essentially comprise a twisted stainless steel double wire with filaments inserted between the twists. The filaments, which may be formed of a suitable material such as nylon, extend radially from the wire. Twisted wire brushes are available in various shapes and sizes to accommodate the diverse needs of users which vary depending upon the shape and size of the teeth and the spacing between them. For example, some twisted wire brushes have a conical shape, while others have a cylindrical shape. Similarly, some brushes have relatively large brush and stem diameters, while others have smaller brush and stem diameters.

In addition to the distinct needs of different users, a single user may have his or her own special needs. For example, the same dental arch may have relatively large interdental spaces at one place and relatively small interdental spaces at another place. Thus, it is desirable to provide an interdental brush handle that can interchangeably receive and hold different types of twisted wire brushes during the same brushing. Moreover, to ensure proper brushing and massaging by the various twisted wire brushes, it is necessary to provide an interdental brush handle which can hold the various brushes equally firmly and securely.

Another important consideration is the ease of brush installation and replacement in the handle. Many people who have bridges or who develop large spaces between their teeth, especially at the gum line, are elderly. Their hands may be stiff, their eyesight may be impaired, or they may have other handicaps that limit their ability to manipulate the brush and handle to accomplish loading the brush into the handle. Thus, it is desirable to provide an interdental brush handle wherein the user can easily insert a twisted wire brush without having to manipulate the stem.

Various interdental brush handles have been disclosed in the prior art. For example, Burns U.S. Pat. Nos. 3,559,226, Tarrson et al. U.S. Pat. No. 4,222,143, Tarrson U.S. Pat. No. 4,319,377 and Schultheiss U.S. Pat. No. 4,780,923 disclose plastic and metal handles for holding twisted wire brushes. The brushes are held perpendicular to the axes of these handles and the brush stems are retained in a bent position. Russell U.S. Pat. No. 4,030,199 shows a handle for holding a twisted brush wire brush parallel to the axis of the handle. A portion of the brush stem is preferably bent so as to prevent its rotation. Thuresson et al. U.S. Pat. No. 5,090,080 discloses a handle for holding a twisted wire brush parallel to the axis of the handle without bending the stem of the brush. Rather, the stem is held in place between projections in the handle. Tarrson et al. U.S. Pat. Nos. 5,027,467 and 5,201,091 show an automatic locking arrangement for capturing a twisted wire brush in a handle. The interdental brush handle of the present invention offers improvements to the twisted wire brush holding and locking arrangements shown in these patents.

SUMMARY OF THE INVENTION

In keeping with an aspect of this invention, an interdental toothbrush handle for holding a twisted wire brush comprises a handle with a locking retainer connected thereto by a living hinge. The handle has two opposing side walls which extend perpendicularly from the handle and are adjacent to the living hinge. At least one of the walls includes a V-shaped gap for receiving the stem of a twisted wire brush. In a preferred embodiment of the invention, the handle also has an indentation between the two opposing side walls and the locking retainer includes a protrusion in communication with the indentation. A nub on the protrusion prevents the locking retainer from opening more than about 30° to 40°.

When the interdental brush handle is used for the first time, the locking retainer is in a fully-open position and the stem of a twisted wire brush is inserted into the V-shaped gap. As the locking retainer is closed, the stem of the twisted wire brush is captured between the handle and locking retainer. A latch on the locking retainer passes through a hole in the handle to lock the retainer in place and hold the stem of the twisted wire brush firmly and securely. When the locking retainer is subsequently opened to remove the current twisted wire brush and insert a new brush, the nub on the protrusion prevents the locking retainer from opening more than about 30° to 40°. When the locking retainer is in this partially-open position, the top portion of the V-shaped gap is blocked by the retainer, thus reducing the size of the gap for the easy insertion of the new twisted wire brush.

The interdental toothbrush handle of the present invention firmly and securely holds twisted wire brushes of various diameters in place. Because the stem of the twisted wire brush is captured over a wide portion of the handle, the present invention provides more stability than any of the prior art interdental brush handles. In addition, because the twisted wire brush projects perpendicularly from the handle, it can easily be worked in between interdental spaces. The twisted wire brush may also be installed and replaced in the interdental toothbrush handle quickly and easily.

DETAILED DESCRIPTION OF THE INVENTION

The inventive interdental brush handle comprises a handle 20 having a locking retainer 22 joined thereto by a living hinge 24, as shown in the figures. A twisted wire brush is seen at 26. When the locking retainer 22 is closed over the handle 20, the brush stem is firmly locked in place.

Figure 1:
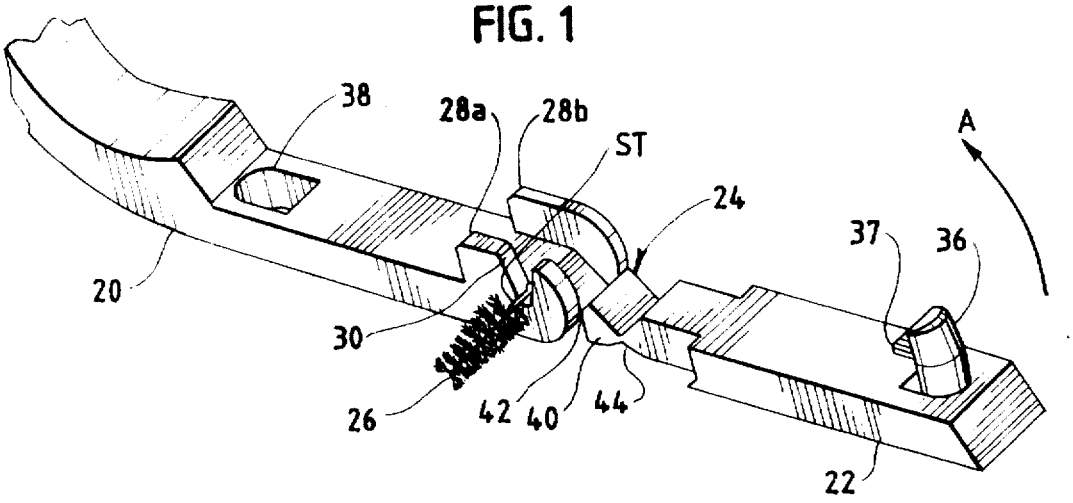
FIG. 1 is a perspective view of one embodiment of the invention, showing the interdental brush handle with the locking retainer in a fully-open position and a twisted wire brush resting in place.
Figure 2:
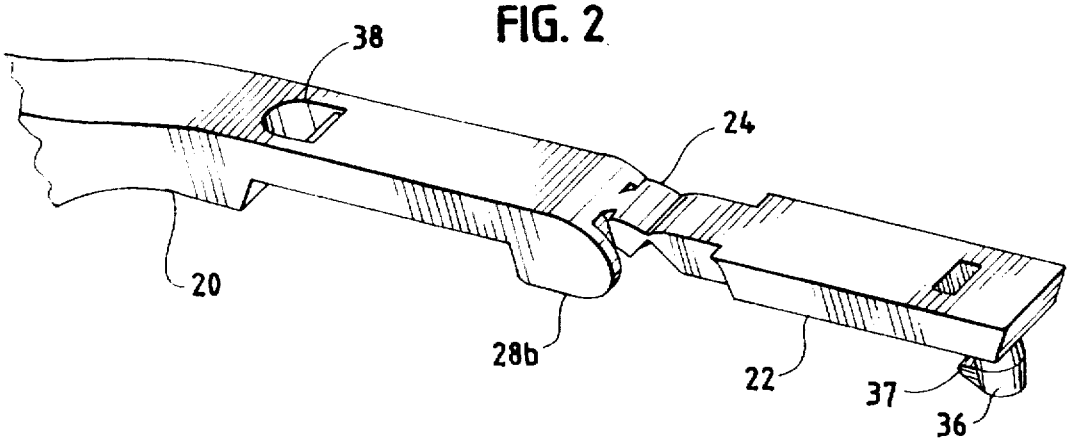
FIG. 2 is a perspective view of the underside of the interdental brush handle shown in FIG. 1.

The handle 20, which may be made of any suitable material, is preferably made of flexible plastic, such as polypropylene. As shown in FIGS. 1 and 2, the handle 20 has two opposing side walls 28*a*, 28*b* which extend perpendicularly from the handle and are adjacent to living hinge 24. Wall 28*a* includes a V-shaped gap 30 for receiving the stem of a twisted wire brush 26. The locking retainer 22 includes an upstanding latch 36. A corresponding keeper hole 38 is positioned in the handle 20 at a point where the latch 36 engages as the locking retainer 22 is moved from an open to a closed position, i.e., in the direction of A. Once the latch 36 clears the far side of the keeper hole 38, the locking retainer 22 is locked into position. The latch edge 37 on the top of latch 36 and at the far end of keeper hole 38 is a double cam which both helps latch and acts as a push button to initiate the opening of locking retainer 22.

Living hinge 24 is preferably a double living hinge which includes a central member 40 having a generally triangular cross-section with a 90° apex angle. Hinge 24 is joined on one side to handle 20 by a thin membrane 42 and joined on the other side to locking retainer 22 by a thin membrane 44. The thin membranes 42, 44 permit locking retainer 22 and handle 20 to pivot relative to each other.

With the locking retainer 22 in a fully-open position, the stem ST of a twisted wire brush 26 is inserted into the V-shaped gap 30 of wall 28*a*, as shown in FIG. 1. The stem ST rests across the handle 20 between opposing side walls 28*a*, 28*b*. As locking retainer 22 is closed, stem ST is captured between the handle 20 and locking retainer 22. The latch 36 on the locking retainer 22 simultaneously passes through the hole 38 in the handle 20 to lock the retainer in place and hold the stem ST of twisted wire brush 26 firmly and securely.

Figure 3:
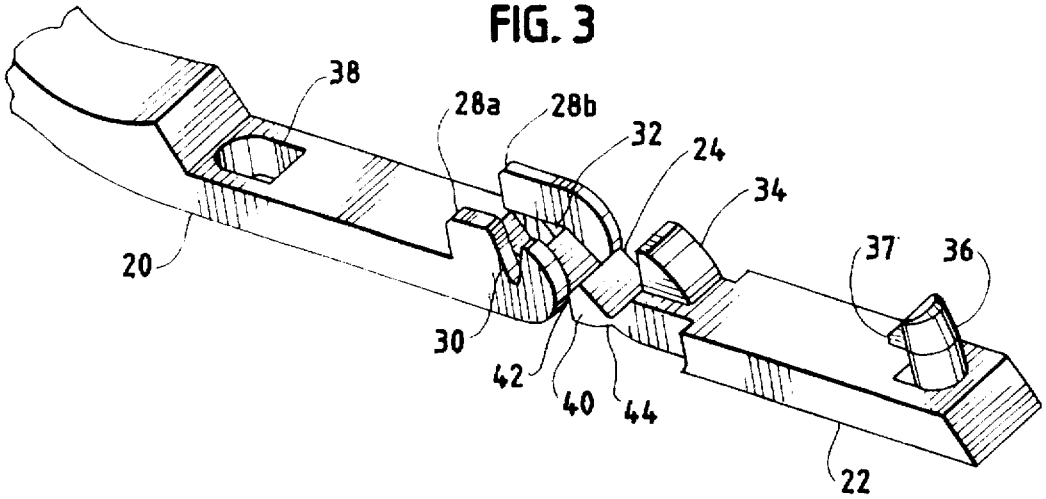
FIG. 3 is a perspective view of another embodiment of the invention, showing the interdental brush handle with an indentation in the handle and a protrusion on the locking retainer in communication therewith.
Figure 4:
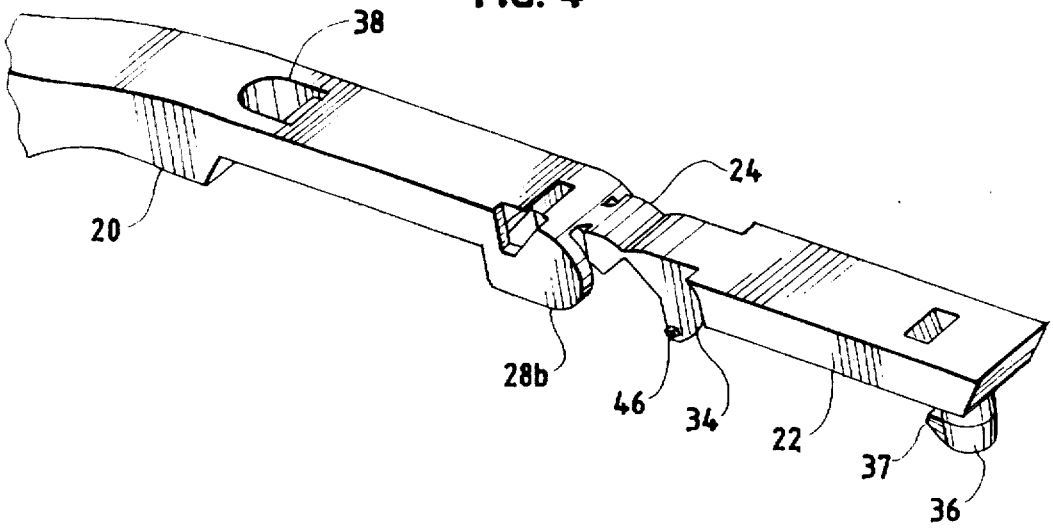
FIG. 4 is a perspective view of the underside of the interdental brush handle shown in FIG. 3.

In an alternative embodiment of the present invention shown in FIGS. 3–6, handle 20 also has an indentation 32 between the two opposing side walls 28*a*, 28*b* and the locking retainer 22 has a protrusion 34 in communication with the indentation (see FIG. 3). The protrusion 34 includes a nub 46, as specifically shown in FIG. 4. Nub 46 frictionally presses against wall. 28*b* to prevent the locking retainer 22 from opening more than about 30° to 40°.

Figure 5:
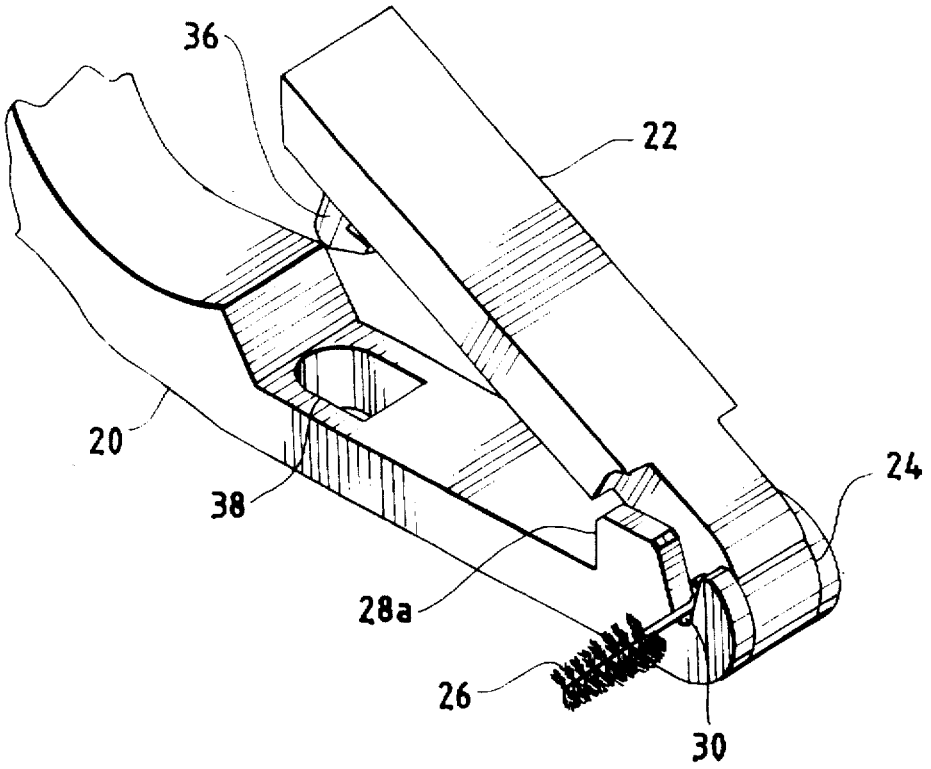
FIG. 5 is a perspective view of the interdental brush handle of FIG. 3 with the locking retainer in a partially-open position.
Figure 6:
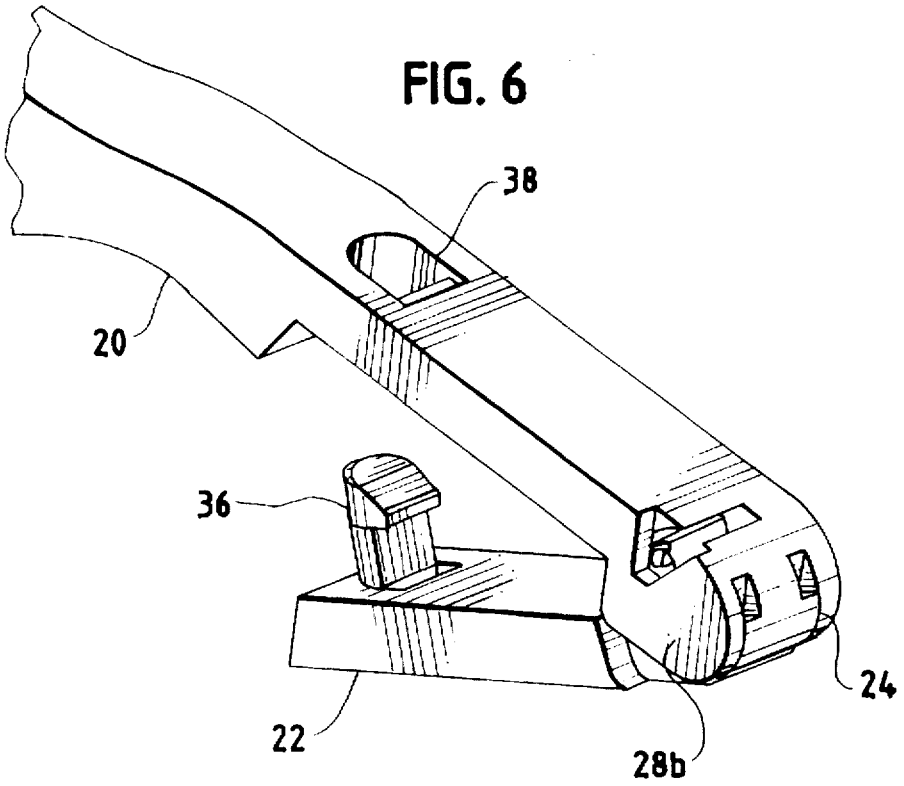
FIG. 6 is a perspective view of the underside of the interdental brush handle shown in FIG. 5.

The inventive interdental brush handle can accommodate twisted wire brushes of various shapes and sizes. Thus, when the user desires to replace the twisted wire brush currently in the interdental brush handle with a different one, the user presses the latch edge 37 of latch 36 to open locking retainer 22. As locking retainer 22 is released, nub 46 on protrusion 34 frictionally presses against wall 28*b* and prevents the retainer from opening more than about 30° to 40°, as shown in FIGS. 5 and 6. When the locking retainer 22 is in this partially-open position, the top portion of V-shaped gap 30 is blocked by the retainer, thereby reducing the size of the gap to facilitate the insertion of the new twisted wire brush. The partially-open position also facilitates the closure of locking retainer 22.

Figure 7:
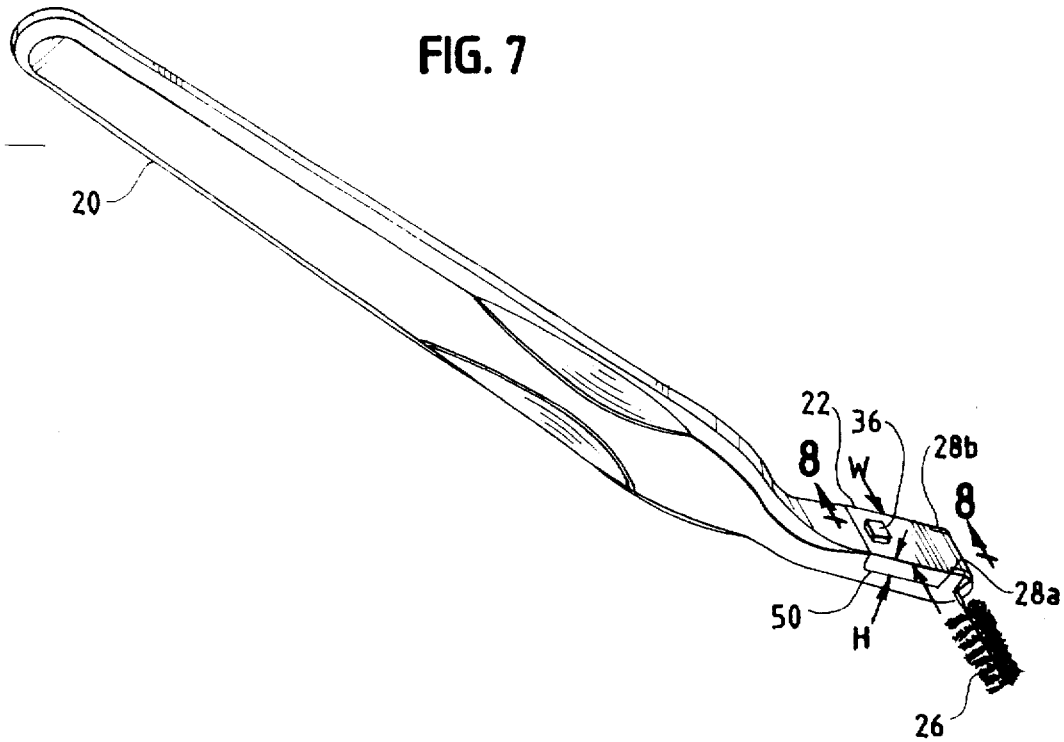
FIG. 7 is a perspective view of the interdental brush handle of the embodiment of FIG. 1 with an entire handle and a twisted wire brush locked in place.
Figure 8:
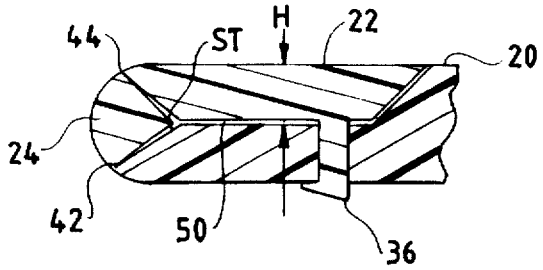
FIG. 8 is a cross-sectional view taken along line 8—8 of FIG. 7.

FIGS. 7 and 8 show the interdental toothbrush handle of FIG. 1 in a closed position with the twisted wire brush locked in place. The handle 20 has a surface area 50 and retainer 22 hinged to one end of handle 20 adjacent to the surface area 50. The retainer 22 swings between an open position (FIG. 1) away from the handle 20 and a closed position (FIGS. 7 and 8) locked in contact with the surface area 50 on the handle 20. The surface area 50 has a width dimension W which is longer than a height H of the retainer 22. Means extending along the width dimension W of the surface area 50 are provided for receiving and gripping a straight portion of stem ST of a twisted wire brush 26 when the retainer is locked in the closed position. This way the brush 26 extends perpendicularly away from the end of the handle 20.

While the present invention is described above in connection with preferred or illustrative embodiments, these embodiments are not intended to be exhaustive or limiting of the invention. Rather, the invention is intended to cover all alternatives, modifications, and equivalents included within its spirit and scope, as defined by the appended claims.

What is claimed is:

1. An interdental toothbrush handle assembly for holding a twisted wire brush having a longitudinal stem, said assembly comprising:

an elongated handle; and an elongated locking retainer pivotally connected to at least one end of the handle by hinge means:

said locking retainer having an overall width dimension and an overall height dimension, said width dimension being greater than said height dimension, said retainer being movable between open and closed positions so that it forms a mutually confronting juncture with a portion of the handle end:

said handle end and said retainer having mating means thereon which capture a portion of the stem of the twisted wire brush therebetween when the retainer is in the closed position, wherein said handle end includes spaced opposing side walls adjacent to the hinge means with at least one of said side walls having a V-shaped gap for receiving the stem of the twisted wire brush, wherein in the closed position the retainer is received in the space between the side walls.

2. The interdental toothbrush handle assembly of claim 1 wherein said mounting means comprises the handle having an indentation between the opposing side walls and the locking retainer having a protrusion in communication with the indentation.

3. The interdental toothbrush handle assembly of claim 2 wherein the protrusion includes means for preventing the locking retainer from opening more than about 30° to 40°.

4. The interdental toothbrush handle assembly of claim 3 wherein the means for preventing is a nub extending from said protrusion.

5. The interdental toothbrush handle assembly of claim 4 wherein the latch receiving means is a recess.

6. The interdental toothbrush handle assembly of claim 4 wherein the latch receiving means is a hole.

7. The interdental toothbrush handle assembly of claim 1 wherein the hinge means is a double living hinge having a central member of a generally triangular cross-section.

8. The interdental toothbrush handle assembly of claim 1 wherein the locking retainer includes a latch and the handle has means for receiving the latch and locking the retainer in place.

9. An interdental toothbrush handle assembly for holding a twisted wire brush having a straight stem, said assembly comprising an elongated handle with a surface area and a retainer hinged to one end of said handle adjacent said surface area and said handle further comprising a pair of spaced parallel side walls standing perpendicularly on said surface area, a gap in one of said side walls for receiving a portion of the straight stem of the wire brush, and the other of said walls forming a surface for protecting soft mouth tissue by covering free end of the twisted wire stem, said retainer swinging on said hinge between an open position away from said handle and a closed position locked in contact with said surface area on said handle said surface area having an overall width dimension which is longer than the an overall height of said retainer, and first mating means extending along said width dimension of said surface area for receiving and gripping a portion of the straight stem of the twisted wire brush when said retainer is locked in said closed position, whereby said brush extends perpendicularly away from said handle.

10. The interdental toothbrush handle assembly of claim 9 wherein said said retainer has second mating means thereon in a position adjacent said hinge for capturing, in cooperation with said first mating means, a portion of the stem therebetween when said retainer is locked in said closed position.

* * * * *